US005169031A

United States Patent [19]

Miller

[11] Patent Number: 5,169,031

[45] Date of Patent: Dec. 8, 1992

[54] DISPENSER FOR DISPENSING CRYOGENIC LIQUID

[75] Inventor: Jeremy P. Miller, Littleworth, United Kingdom

[73] Assignee: Air Products and Chemicals, Inc., Allentown, Pa.

[21] Appl. No.: 723,867

[22] Filed: Jul. 1, 1991

Related U.S. Application Data

[62] Division of Ser. No. 317,314, Mar. 1, 1989, abandoned.

[30] Foreign Application Priority Data

Feb. 29, 1988 [GB] United Kingdom ..... 8804760

[51] Int. Cl.[5] ..... F17C 9/00

[52] U.S. Cl. ..... 222/146.5; 222/67; 222/481.5; 62/50.2; 239/133; 239/136

[58] Field of Search ..... 222/504, 481.5, 484, 222/131, 146.1, 146.2, 146.5, 67; 251/65, 129.15, 129.22; 62/50.1, 50.2; 239/132, 133, 136; 220/901

[56] References Cited

U.S. PATENT DOCUMENTS

| | | | |
|---|---|---|---|
| 2,733,848 | 2/1956 | Houwers | 222/481.5 |
| 3,126,711 | 3/1964 | Miller | 62/52 |
| 3,418,822 | 12/1968 | Massey | 62/55 |
| 3,548,607 | 12/1970 | Pillsbury, Jr. et al. | 62/52 |
| 3,648,018 | 3/1972 | Cheng et al. | 222/146 X |
| 3,729,946 | 5/1973 | Massey | 62/55 X |
| 4,018,419 | 4/1977 | Monpetit | 251/65 |
| 4,564,046 | 1/1986 | Lungu | 251/65 X |
| 4,592,205 | 6/1986 | Brodbeck et al. | 62/50.1 X |
| 4,690,371 | 9/1987 | Bosley et al. | 251/65 |
| 4,715,187 | 12/1987 | Stearns | 62/55 |
| 4,726,194 | 2/1988 | Mackay et al. | 62/55 |
| 4,825,904 | 5/1989 | Grau et al. | 251/65 X |

FOREIGN PATENT DOCUMENTS

| | | |
|---|---|---|
| 2091228 | 7/1982 | United Kingdom . |
| 2092552 | 8/1982 | United Kingdom . |
| 2169998 | 7/1986 | United Kingdom . |

*Primary Examiner*—Andres Kashnikow
*Assistant Examiner*—Anthoula Pomrening
*Attorney, Agent, or Firm*—James C. Simmons; William F. Marsh

[57] ABSTRACT

A dispenser for cryogenic liquid comprising a vacuum insulated vessel (2) which is provided with a dispenser tube (10). The dispenser tube (10) is heated in use by an electric heater (11). Sufficient heat is supplied to achieve film boiling on the inner surface of the dispenser tube (10). Flow of cryogenic liquid from the vacuum insulated vessel (2) into the dispenser tube (10) is controlled by a tapered valve member (14) which is biased downwardly by a spring (15) and which is connected to a permanent magnet (16) disposed in a coil (17). The tapered valve member (14) can be driven upwardly or downwardly according to the sense in which a direct current is applied to the coil (17). A gas relief tube (18) is provided to vent gas from the dispenser tube (10) intermediate the tapered valve member (14) and the outlet of the dispenser tube (10). The gas relief tube (18) conveys gas to the space above the cryogenic liquid, for example liquid nitrogen, in the vacuum insulated vessel (2). The dispenser has particular utility in high speed canning and bottling lines.

2 Claims, 1 Drawing Sheet

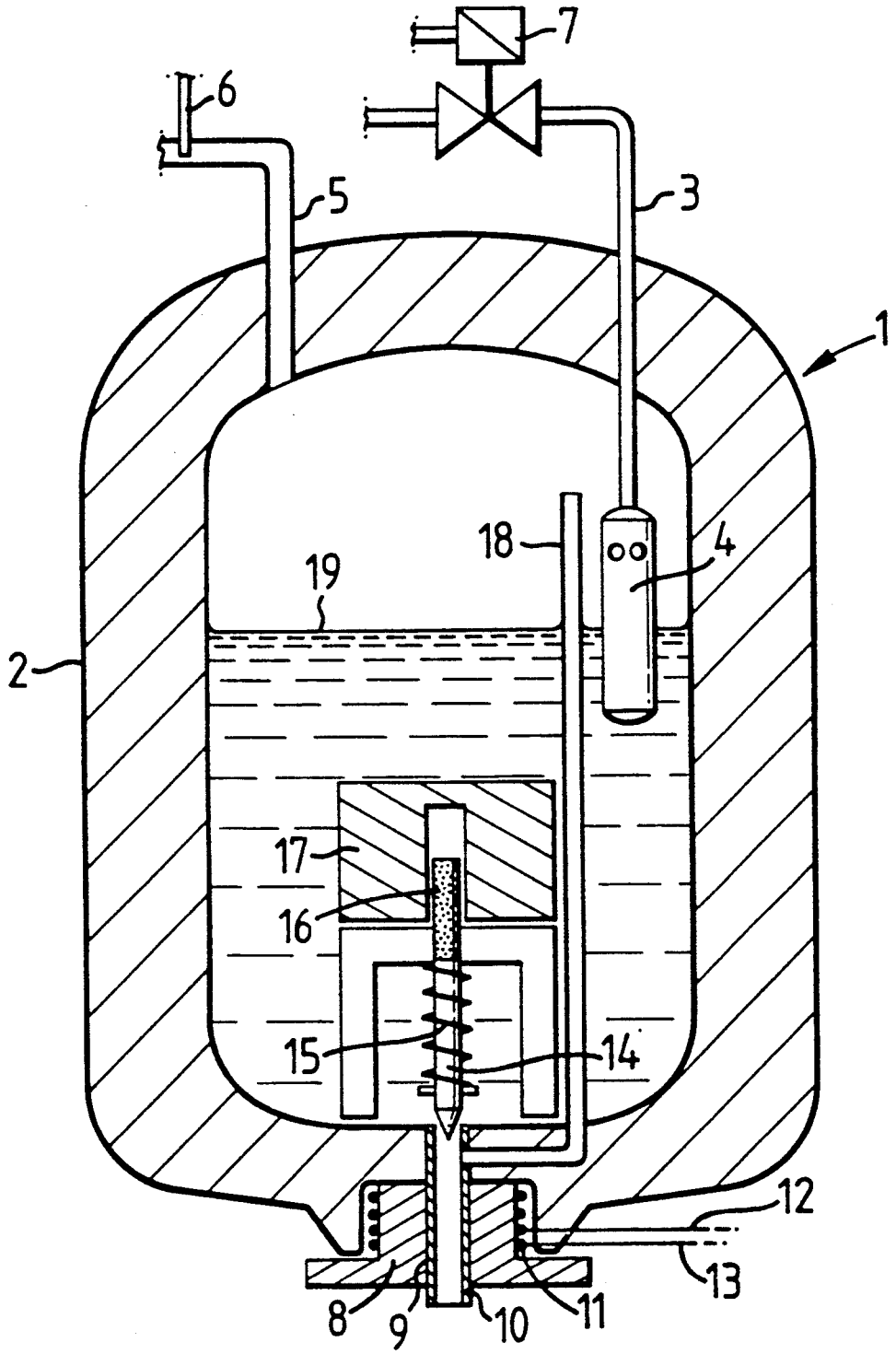
7
6
5
3
1
18
4
19
2
17
16
15
14
12
13
8
9
10
11

DISPENSER FOR DISPENSING CRYOGENIC LIQUID

CROSS-REFERENCE TO RELATED APPLICATION

This is a division of application Ser. No. 07/317,314 filed Mar. 1, 1989, now abandoned.

FIELD OF THE INVENTION

This invention relates to a dispenser for dispensing cryogenic liquid and to a method of controlling the flow of cryogenic liquid from a dispenser.

BACKGROUND OF THE INVENTION

In the canning and bottling industries it is common practice to insert a small quantity of liquid nitrogen into the cans or bottles immediately prior to closure. The liquid nitrogen vaporizes in the can or bottle and displaces air from the can or bottle before the closure is applied.

When filling cylindrical cans of uniform diameter it is quite convenient to dispense liquid nitrogen in a continuous spray since the percentage of liquid nitrogen wasted is relatively small. However, this technique is extremely wasteful for bottles having relatively small necks, for example beer bottles.

In order to introduce liquid nitrogen into beer bottles it has been proposed to drop a discrete quantity of liquid nitrogen into each beer bottle immediately prior to closure. However, apparatus for effecting this process has not worked particularly successfully. In particular, instead of discrete slugs or droplets of liquid nitrogen descending into the bottles from a dispenser the bottles have been assailed by a diverging cone of minute droplets only a tiny portion of which enter the bottle. This problem has been variously attributed to:

(1) the liquid nitrogen (boiling point −196° C.) starting to vaporize in the dispenser tube, i.e., the tube between a vacuum insulated vessel containing the cryogenic liquid and the atmosphere; and (2) ice forming and partially blocking the outlet of the dispenser tube.

In order to compensate for the former problem the prior art has attempted to keep the dispenser tube as cold as possible (see UK 2 092 552A). Whilst such attempts marginally improved the situation the problem was still apparent particularly on high speed bottling lines. Furthermore, the additional cooling aggravated the existing problem of ice and frost build up on and obstructing the outlet of the dispenser tube.

In order to overcome the second problem it has been proposed to provide a blanket of cold gaseous nitrogen circumjacent the dispenser tube (see FIG. 1 of UK 2 169 998A).

SUMMARY OF THE INVENTION

The present invention approaches the problem from a totally different perspective. In particular, instead of cooling the dispenser tube heat is applied to the dispenser tube to achieve film boiling in the dispenser tube.

Film boiling occurs when the heating supply is sufficiently high that a thin film of vapor separates a heating element from the liquid which is being heated. The thin film of vapor acts as an insulator between the heating element and the liquid. Film boiling can easily be recognized since the rate of heat transfer from the heating element to the liquid drops dramatically from that prior to film boiling.

We have found that if sufficient heat is applied to the dispenser tube the gas film which is formed on the inside of the dispenser tube acts in such a way that discrete slugs of liquid nitrogen can be dispensed from the dispenser tube. Furthermore, the slugs can be dispensed at very high rates if desired, for example up to 2000 slugs per minute.

According to the present invention there is provided a dispenser for dispensing slugs of cryogenic liquid to bottles or cans on a bottling or canning line, which dispenser comprises a vessel for holding cryogenic liquid, and a dispenser tube associated with said vessel, characterized in that means are provided for heating cryogenic fluid in said dispenser tube whilst said dispenser is in use.

Preferably, the means comprises an electric heating element.

BRIEF DESCRIPTION OF THE DRAWING

The single FIGURE of the drawing is a vertical cross-section through a dispenser according to the present invention.

DESCRIPTION OF THE PREFERRED EMBODIMENT

The present invention also provides a method for dispensing slugs of cryogenic liquid from a dispenser having a dispenser tube to bottles or cans on a bottling or canning line, characterized in that said method comprises the step of heating said dispenser tube to produce film boiling on the inner surface thereof.

Preferably, the method includes the steps of opening and closing a valve to permit or inhibit liquid entering said dispenser tube.

If desired the valve may be opened and closed at a rate greater than 1000 cycles per minute.

Conventionally, dispenser tubes are mounted on the bottom of a highly insulated vessel which contains the cryogenic liquid. The flow of cryogenic liquid is controlled by a long rod which extends from a solenoid mounted on top of the vessel, through the vessel to a valve mounted on the top of the dispenser tube. One problem associated with this arrangement is that it does not work at relatively high frequencies and suffers from resonance.

In order to help overcome these problems the present invention provides a dispenser for dispensing a cryogenic liquid, which dispenser comprises a vessel, a dispenser tube mounted on said vessel, a valve associated with said dispenser tube and operable, in use, to allow or inhibit the flow of cryogenic liquid from said vessel, and means which are wholly contained within said vessel for opening and closing said valve, characterized in that said means are capable of opening and closing said valve at least 600 times per minute.

Preferably, said means for opening and closing said valve comprises a permanent magnet connected to said valve, and a coil circumjacent said permanent magnet and arranged to receive, in use, direct current.

In conventional dispensers a globule of liquid nitrogen remains in the dispenser tube after each injection due to surface tension. If the canning or bottling line is stopped for any reason part of the globule evaporates. The vapor thus formed collects between the valve and the globule and ejects the globule downwardly. If a can or bottle is below the dispenser tube at the time it thus receives more liquid nitrogen than intended. If the canning or bottling line is restarted soon after this happens the can or bottle can be sealed whilst it contains excess nitrogen. Because of the 700:1 volumetric expansion when liquid nitrogen evaporates this can be followed by the can or bottle closure being blown off or, in some cases, the can or bottle breaking or exploding.

In order to reduce this problem the present invention provides a dispenser for dispensing slugs of cryogenic liquid to bottles or cans on a bottling or canning line, which dispenser comprises a vessel for holding cryogenic liquid, a dispenser tube having an outlet, and a valve for, in use, controlling the flow of cryogenic liquid from said vessel through said dispenser tube, characterized in that a gas relief tube is provided which communicates with said dispenser tube between said valve and said outlet.

Preferably, said gas relief tube is arranged to relieve gas from said vessel tube into said dispenser, preferably at a level which, when said dispenser is in use, is above the level of the cryogenic liquid in said vessel.

For a better understanding of the present invention reference will now be made, by way of example, to the accompanying drawing which is a diagrammatic vertical section through a dispenser for dispensing cryogenic liquid in accordance with the invention.

Referring to the drawing, there is shown a dispenser which is generally identified by reference numeral 1.

The dispenser 1 comprises a vacuum insulated vessel 2. An inlet conduit or pipe 3 extends downwardly through the vacuum insulated vessel 2 to a float valve 4. A vent pipe 5 extends upwardly from the vacuum insulated vessel 2 and is provided with a sensor 6 which is arranged to close safety valve 7 in pipe 3 if liquid is detected in the vent pipe 5.

A dispenser head 8 is mounted on the bottom of the vacuum insulated vessel 2. The dispenser head 8 is provided with a central bore 9 which is disposed circumjacent and in intimate thermal contact with a dispenser tube 10 which extends downwardly from the inside of the vacuum insulated vessel 2.

The dispenser head 8 is provided with a heater 11 which can be connected to a source of electric power via wires 12 and 13.

The upper end of the dispenser tube 10 can be opened or closed by means of a tapered valve member 14 which is biased downwardly by a spring 15. The tapered valve member 14 is connected to a permanent magnet 16 disposed in a coil 17 which, when actuated by a DC current in one sense, raises the tapered valve member 14 to open the upper end of the dispenser tube 10. When the DC field is reversed the tapered valve member 14 is driven down. This arrangement gives positive control compared with the solenoid and spring arrangement of the prior art which relies on the spring to close the valve.

A gas relief tube 18 extends from a position in the dispenser tube 10 between the tapered valve member 14 and the outlet of the dispenser tube 10 and opens in the vacuum insulated vessel 2 above the float valve 4.

In use, safety valve 7 is opened and liquid nitrogen flows into the interior of the vacuum insulated vessel 2 through pipe 3 until it reaches level 19 when the float valve 4 closes. Vapor leaves the vacuum insulated vessel 2 via the vent pipe 5.

Power is applied to heater 11 to warm the dispenser head 8.

When a slug of nitrogen is required a DC current is applied in the appropriate sense to coil 17 thereby raising permanent magnet 16 against the bias of spring 15. Liquid nitrogen then enters the top of dispenser tube 10.

The heater 11 transmits sufficient heat such that a film of gas is formed on the inner surface of the dispenser tube 10. This acts as an insulating and lubricating barrier which permits individual slugs of liquid nitrogen to pass downwardly through the dispenser tube 10. The liquid nitrogen emerges from the bottom of the dispenser tube 10 in the form of slugs of liquid with negligible or little dispersion compared with the prior art. Vapor in the dispenser tube 10 rises through the gas relief tube 18 into the vacuum insulated vessel 2 and thence to vent pipe 5.

Clearly the power input to the heater 11 depends on the frequency with which the coil 17 is actuated and the volume of liquid nitrogen being released with each operation.

In order to set up the equipment correctly the coil 17 is first operated at the desired frequency with the level of liquid nitrogen in the vacuum insulated vessel 2 being maintained substantially constant by float valve 4.

At first the nitrogen leaves the bottom of the dispenser tube 10 in the form of a diffuse atomized cone, i.e., in the form common to the prior art. Power is then applied to heater 11 slowly to allow for the heat capacity of the dispenser head 8.

As the power increases the volume of the spray appears to decrease. However, beyond a certain point the discharge turns into a stream of discrete slugs of liquid nitrogen which fall vertically downwardly like droplets of water. These slugs can be directed into the necks of beer bottles and the like with little or no difficulty. Furthermore, work with a prototype according to the invention suggests that a single dispenser may be capable of delivering discrete slugs of liquid nitrogen to as many as 2000 bottles per minute on a high speed bottling line.

As a by-product of the heater 11 ice does not accumulate on the base of the dispenser head 8. In this connection it should be noted that heaters have previously been used to prevent ice accumulating on the base of dispenser heads (see UK 2 091 228A). However, in such arrangements special arrangements have been made to ensure that the dispensing tube is kept cold, in particular by passing cold nitrogen vapor circumjacent the dispensing tube in the aforesaid patent specification and positioning the dispensing tube well away from the base. It should also be noted that the aforesaid specification discloses the use of a separate heater for removing ice from the dispenser during shutdown. However, it is explained that this heater is deactivated during start-up, i.e., it is not used whilst the dispenser is dispensing liquid.

EXAMPLE

Liquid nitrogen slugs having an average volume of 0.037 cc were dispensed at a rate of 600 slugs/minute through a dispenser tube made of brass and having a nominal external diameter of 5 mm and a nominal internal diameter of 3 mm. The dispenser head 8 was made from high purity copper.

At equilibrium the heater 11 consumed 32 watts of power.

What is claimed is:

1. A dispenser for dispensing a cryogenic liquid, which dispenser comprises a vessel, a dispenser tube mounted on said vessel, a valve associated with said dispenser tube and operable, in use, to allow or inhibit the flow of cryogenic liquid from said vessel through said dispenser tube, and means which are wholly contained within said vessel for opening and closing said valve, characterized in that:

said dispenser is so constructed and arranged for direct gravity feed of cryogenic liquid contained within said vessel through said dispenser tube and outwardly of said vessel with at least a portion of said dispenser tube projecting outwardly of said vessel;

a dispenser head disposed around said portion of said dispenser tube projecting from said vessel, said dispenser head including means to heat said dispenser tube to effect film boiling of said cryogenic liquid as it passes through said dispenser tube;

said means for opening and closing said valve comprises a permanent magnet connected to said valve, and a coil circumjacent said permanent magnet arranged to receive, in use, direct current and said means are capable of opening and closing said valve at least 600 times per minute; and a float disposed within said vessel and a control valve exterior of said vessel connected to a source of cryogenic liquid, said float being in fluid communication with said control valve and said float and said control valve cooperating to effect a maximum level of cryogenic liquid permitted to enter said vessel.

2. A dispenser for dispensing a cryogenic liquid, which dispenser comprises a vessel, a dispenser tube mounted on said vessel, a valve associated with said dispenser tube and operable, in use, to allow or inhibit the flow of cryogenic liquid from said vessel through said dispenser tube, and means which are wholly contained within said vessel for opening and closing said valve, characterized in that:

said dispenser is so constructed and arranged for direct gravity feed of cryogenic liquid contained within said vessel through said dispenser tube and outwardly of said vessel with at least a portion of said dispenser tube projecting outwardly of said vessel;

a dispenser head disposed around said portion of said dispenser tube projecting from said vessel, said dispenser head including means to heat said dispenser tube to effect film boiling of said cryogenic liquid as it passes through said dispenser tube;

said means for opening and closing said valve comprises a permanent magnet connected to said valve, and a coil circumjacent said permanent magnet arranged to receive, in use, direct current and said means are capable of opening and closing said valve at least 600 times per minute; and a gas relief tube communicating with said dispenser tube below said valve and extending into the interior of said vessel above the maximum level of said cryogenic liquid present in said vessel prior to use for dispensing cryogenic liquid whereby vaporized cryogenic liquid resulting from the film boiling in said dispenser tube is directed to the interior of said vessel.

* * * * *